United States Patent [19]

Winkley

[11] 4,284,589

[45] Aug. 18, 1981

[54] TAMPER RESISTANT CHOKE PULL-OFF

[75] Inventor: Jerry H. Winkley, St. Louis, Mo.

[73] Assignee: ACF Industries, Inc., New York, N.Y.

[21] Appl. No.: 90,733

[22] Filed: Nov. 2, 1979

[51] Int. Cl.[3] ..... F02M 1/10

[52] U.S. Cl. ..... 261/39 B; 137/382

[58] Field of Search ..... 261/39 B, DIG. 38; 137/382

[56] References Cited

U.S. PATENT DOCUMENTS

| | | | |
|---|---|---|---|
| 1,166,023 | 12/1915 | Vallier | 137/382 |
| 2,140,529 | 12/1938 | Kemp | 137/382 |
| 3,285,279 | 11/1966 | Rosbrook | 261/39 B |
| 3,291,148 | 12/1966 | Sloan | 137/382 |
| 3,406,708 | 10/1968 | Maydock | 137/382 |
| 3,800,762 | 4/1974 | McCullough | 261/39 B |
| 3,947,531 | 3/1976 | Branigin | 261/39 B |
| 4,095,713 | 6/1978 | Norton | 137/382 |
| 4,132,751 | 1/1979 | Winkley | 261/39 B |
| 4,144,292 | 3/1979 | Witt et al. | 261/39 B |

FOREIGN PATENT DOCUMENTS

| | | | |
|---|---|---|---|
| 2855172 | 8/1979 | Fed. Rep. of Germany | 137/382 |

*Primary Examiner*—Tim R. Miles

*Attorney, Agent, or Firm*—J. Joseph Muller

[57] ABSTRACT

The vacuum motor and link assembly used to pull-off a carburetor choke valve when an engine is started is made tamper resistant to prevent someone from changing the position at which the vacuum motor causes the choke valve to open. A cover is installed on the carburetor and shrouds the vacuum motor, link, and the portion of a choke shaft to which the link is connected thereby to prevent access to these parts.

4 Claims, 7 Drawing Figures

TAMPER RESISTANT CHOKE PULL-OFF

BACKGROUND OF THE INVENTION

This invention relates to tamperproofing of a carburetor and, more particularly, to making the choke valve pull-off mechanism of the carburetor tamper resistant.

As a step toward reducing pollution caused by automobile engines, various portions of a carburetor are now required to be tamper resistant. This is done to prevent adjustments in carburetor operation after the carburetor has been adjusted to baseline specifications during manufacture. Since these baseline specifications are established, inter alia, with keeping engine exhaust emissions to a minimum, it is expected that by preventing later adjustments to the carburetor, engine exhausts will be kept to a minimum.

SUMMARY OF THE INVENTION

Among the several objects of the present invention may be noted the provision of tamper resistant means for inhibiting tampering with the choke valve pull-off mechanism; the provision of such tamper resistant means by which later adjustment of the choke valve pull-off mechanism, after an initial adjustment is made, is prevented; and the provision of such tamper resistant means which is quickly and easily installed on the carburetor during its manufacture.

Briefly, the improvement of the present invention comprises means for making the vacuum motor and link assembly used to pull-off the choke valve of a carburetor when an engine is started tamper resistant to inhibit someone from changing the position at which the vacuum motor causes the choke valve to open. The tamper resistant means includes a cover installable on the carburetor. The cover partially shrouds the vacuum motor, and encloses the link, and the portion of a choke shaft to which the link is connected thereby to prevent access to these parts. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
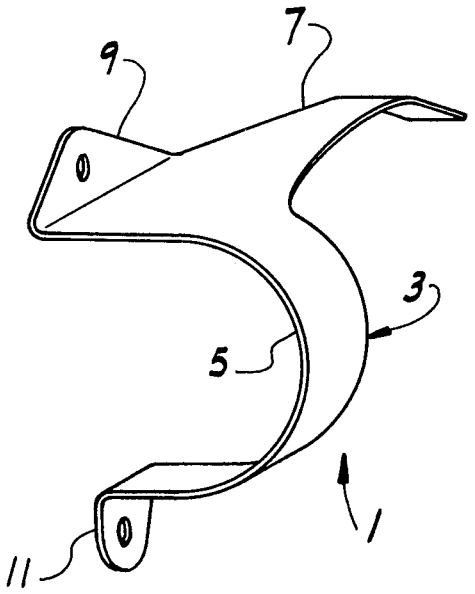
FIG. 1 is a perspective view of a cover comprising a first embodiment of the improvement of the present invention.

Referring to the drawings, a carburetor C (FIG. 2) has an air passage AP through which air is drawn into an internal combustion engine (not shown) on which the carburetor is mounted. A choke valve V is positioned at the inlet of the air passage and is pivotally mounted on a choke shaft S for opening and closing the choke valve. A vacuum motor M is mounted on a bracket B which is attached to the body of carburetor C and a link L connects the vacuum motor to the choke shaft all as is well known in the art. The vacuum motor, link, and choke shaft, in effect, constitute a choke pull-off mechanism.

Typically, choke valve V is closed when the engine on which carburetor C is mounted is started and this results in a rich air-fuel mixture being supplied to the engine to start it. Vacuum motor M is responsive to the vacuum created in an intake manifold of the engine, when the engine starts, to exert an opening force on the choke valve, via link L, to "crack" or initially open the choke valve. This permits air to be drawn into air passage AP and leans out the air-fuel mixture supplied to the engine. The length of link L determines when operation of vacuum motor M will open choke valve V and the link is adjusted to an appropriate length, as determined by the operating characteristics carburetor C is to have, during manufacture of the carburetor. One element included in determining operating characteristics of the carburetor is engine emissions. Because of the present engine emission levels established, it is desirable to open choke valve V as soon as possible after engine starting because the rich air-fuel mixture needed to start the engine also produces high engine emissions. By leaning out the mixture soon after engine starting, overall engine emission levels are significantly reduced. However, nothing presently prohibits a user of carburetor C from reworking link L so the length of the link is increased. The effect of this is that choke valve V will remain closed longer than manufacturer's specifications set out and increased engine exhaust emissions will occur.

Figure 2:
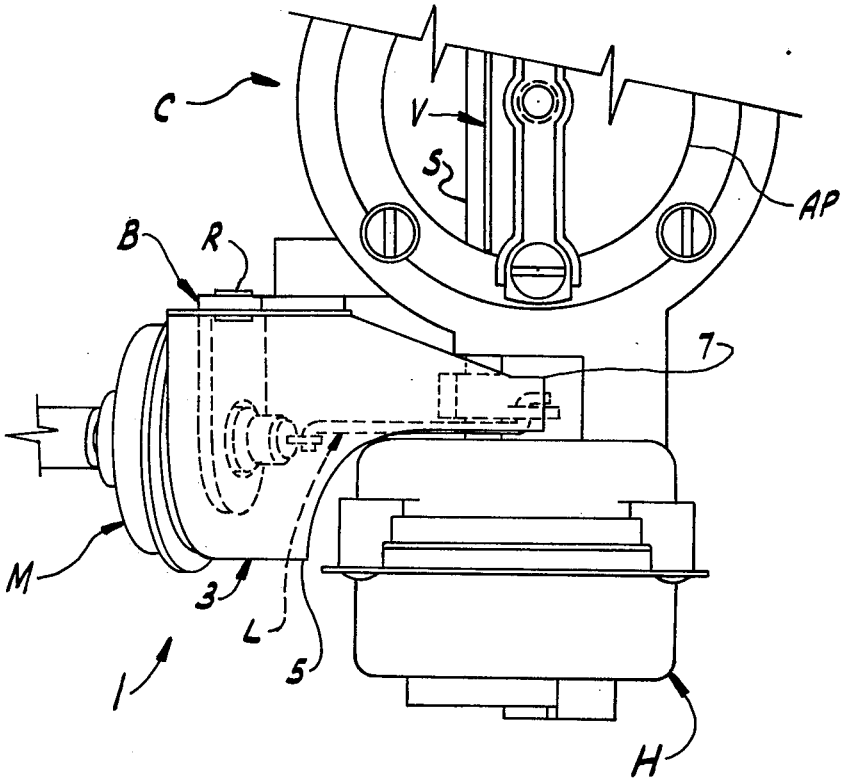
FIGS. 2 and 3 are partial top plan and partial side elevational views respectively of the installation of the cover on a carburetor.
Figure 3:
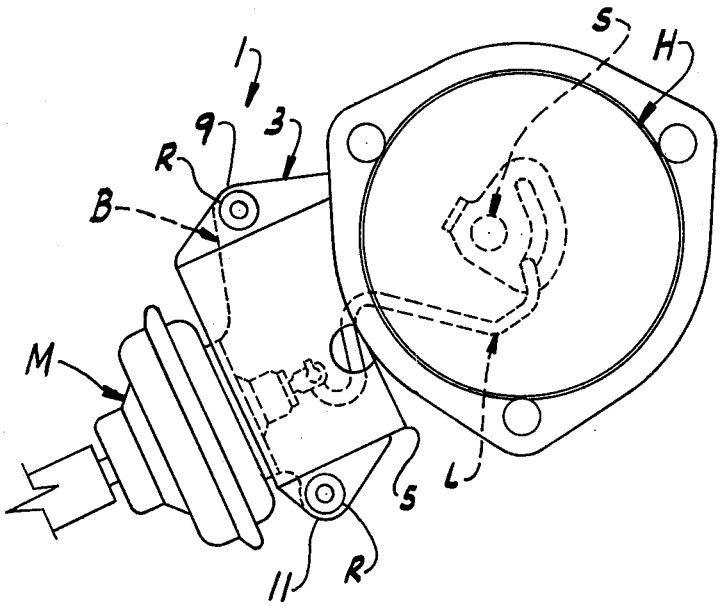

The improvement of the present invention comprises means 1 for making the vacuum motor and link assembly tamper resistant to inhibit someone from changing the position at which the vacuum motor causes the choke valve to open by tampering with the link. Means 1 includes a cover 3 installable on carburetor C to shroud vacuum motor M, link L, and the portion of choke shaft S to which the link is connected. This prevents access to these parts and thus frustrates someone attempting to tamper with the carburetor after manufacture. As shown in FIG. 1, cover 3 has a semi-circular rear portion 5 contoured to fit over the forward end of vacuum motor M and a forwardly extending arm 7 which projects forward from the upper front section of portion 5. As shown in FIG. 2, arm 7 is contoured to fit between the body of carburetor C and a choke break housing H installed outwardly of the carburetor body. The length of arm 7 is sufficient to substantially cover the portion of choke shaft S extending from the carburetor body.

Cover 3 is attachable to bracket B and has upper and lower flanges, 9 and 11 respectively, which abut the bracket. The cover is preferably attached to the bracket by rivets R inserted into the upper and lower flanges although other suitable methods of attachment may be used.

With cover 3 installed, someone attempting to tamper with the vacuum motor-link assembly cannot get a tool or other device under the cover and thus is prevented from changing the point at which the vacuum motor causes the choke valve to open.

Figure 4:
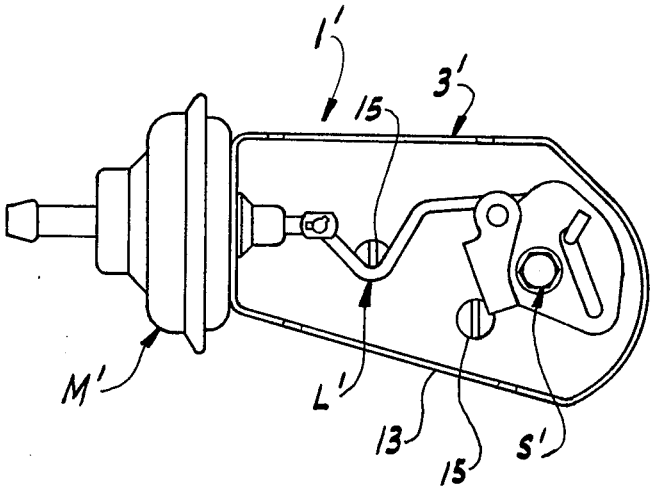
FIGS. 4 and 5 are side elevational and top views respectively of a portion of a cover comprising a second embodiment of the improvement of the present invention.
Figure 5:
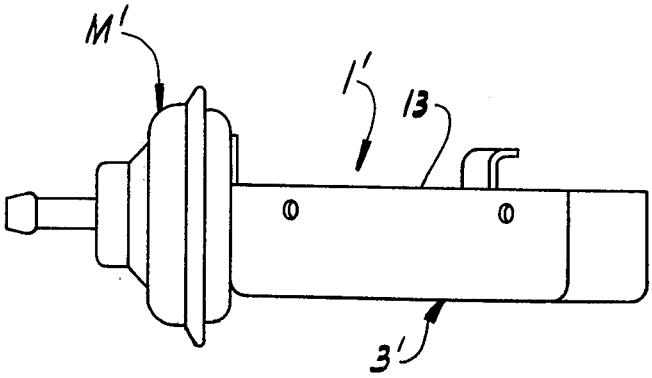

Referring to FIGS. 4 through 7, a second embodiment of the present invention is shown in which a means 1' comprises a two-piece cover 3', one piece 13 of which is integrally formed with the bracket by which vacuum motor M' is mounted on a carburetor. As shown in FIGS. 4 and 5, piece 13 of cover 3' forms both the back and sides of the cover. This piece is attached to the body of a carburetor by screws 15 (see FIG. 4).

Figure 6:
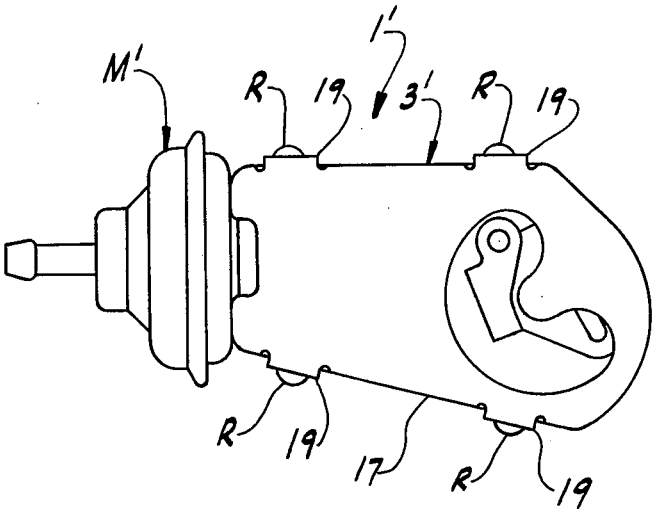
FIGS. 6 and 7 are views similar to FIGS. 4 and 5 respectively with a cover plate installed.
Figure 7:
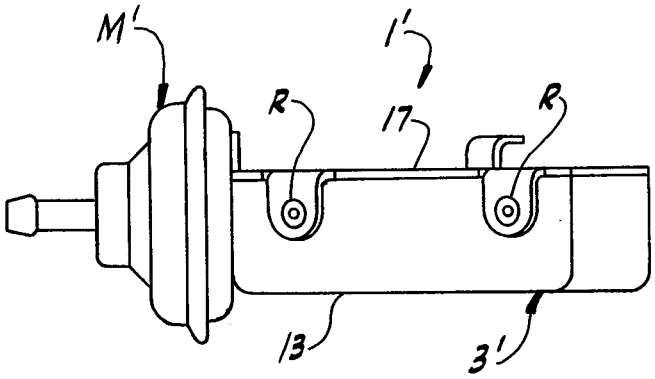

As shown in FIGS. 6 and 7, cover 3' further includes a front plate 17 (the second piece of the cover) attachable to piece 13 of the cover. Plate 17 has four inwardly extending fingers 19, two at its upper end and two at its lower end, by which the plate is attached to cover piece 13 by rivets R. The plate has an opening 21 at its forward end to accommodate the inward end of choke break housing H and the portion of choke shaft S extending out from the carburetor body. In effect, cover 3' completely encloses the vacuum motor link assembly to inhibit someone from tampering with choke break adjustment. As a result, choke break operation will conform to manufacturer's specification with minimal engine emissions resulting.

It will be understood that cover 3 and cover 3' are hardened to make it even more difficult to gain access to the choke pull-off mechanism. Further, the upper fingers 19 of plate 17 may have L-shaped ends which fit into appropriate slots in the top of piece 13. In this instance, the upper two rivets R are not needed.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. In a carburetor for an internal combustion engine, the carburetor having an air passage through which air is drawn into the engine, a choke valve positioned at the inlet of the passage, the choke valve being pivotally mounted on a choke shaft for opening and closing the choke valve, a choke housing and a vacuum motor attached to the body of the carburetor at a location remote from the choke housing, and a link connecting the vacuum motor and the choke shaft for the vacuum motor to exert a choke valve opening force on the choke shaft when the engine is started, the improvement comprising means for making the vacuum motor and link assembly tamper resistant to inhibit someone from changing the position at which the vacuum motor causes the choke valve to open, the tamper resisting means including a cover installed on the carburetor and shrouding at least a part of the vacuum motor, the link, and the portion of the choke shaft to which the link is connected thereby to inhibit access to these parts, the vacuum motor being mounted on a bracket attached to the carburetor and the cover being attachable to the bracket and having a semi-circular rear portion and a forwardly extending arm covering the link, the length of the arm portion being sufficient to also substantially cover the portion of the choke shaft extending from the body of the carburetor, the link being connected to this extending portion of the choke shaft.

2. In a carburetor for an internal combustion engine, the carburetor having an air passage through which air is drawn into the engine, a choke valve positioned at the inlet of the passage, the choke valve being pivotally mounted on a choke shaft for opening and closing the choke valve, a choke housing and a vacuum motor attached to the body of the carburetor at a location remote from the choke housing, and a link connecting the vacuum motor and the choke shaft for the vacuum motor to exert a choke valve opening force on the choke shaft when the engine is started, the improvement comprising means for making the vacuum motor and link assembly tamper resistant to inhibit someone from changing the position at which the vacuum motor causes the choke valve to open, the tamper resisting means including a cover installed on the carburetor and shrouding at least a part of the vacuum motor, the link, and the portion of the choke shaft to which the link is connected thereby to inhibit access to these parts, the vacuum motor being mounted on a bracket attached to the carburetor and the cover being formed of two pieces, one piece of which is integrally formed with the bracket.

3. The improvement as set forth in claim 2 wherein the portion of the cover formed with the bracket forms the back and sides of the cover.

4. The improvement as set forth in claim 3 further including a front plate attachable to the bracket to complete the cover, the link and choke shaft being substantially enclosed by the cover when the front plate is attached.

* * * * *